United States Patent [19]

Boudreau

[11] 4,409,720

[45] Oct. 18, 1983

[54] DUAL FUNCTION, SINGLE STROKE PRESSING DEVICE

[76] Inventor: Joseph E. Boudreau, 19 Lincoln St., Trumbull, Conn. 06611

[21] Appl. No.: 208,049

[22] Filed: Nov. 18, 1980

[51] Int. Cl.[3] ..... B25C 7/00

[52] U.S. Cl. ..... 29/432.1; 29/243.5; 29/252

[58] Field of Search ..... 29/243.5, 432.1, 252, 29/522 R; 83/639

[56] References Cited

U.S. PATENT DOCUMENTS

| | | | |
|---|---|---|---|
| 3,111,868 | 11/1963 | Riggio . | |
| 3,465,410 | 9/1969 | Ernest et al. . | |
| 3,602,974 | 11/1968 | Koett | 29/432.1 |
| 3,750,606 | 8/1973 | Schultz | 29/252 |
| 3,949,631 | 4/1976 | Goldman et al. | 83/639 |
| 4,035,901 | 7/1977 | Lux et al. . | |
| 4,175,314 | 11/1979 | Spehrley | 29/432.1 |

OTHER PUBLICATIONS

"Di-Dro Systems for the Metal Stamping Industry", Di-Dro Systems, Inc., Apr. 1974.

*Primary Examiner*—Robert C. Watson

*Attorney, Agent, or Firm*—Fitzpatrick, Cella, Harper & Scinto

[57] ABSTRACT

A dual function device for pressing a workpiece in a single stroke of a press ram comprises a housing that carries first and second tools each having a working end that protrudes from one end of the housing. The housing can be removably attached, at an end opposite the one end, to the press ram. The first tool has a shank portion that includes a piston slidable in a piston chamber formed in the housing. Pressurized liquid may fill the piston chamber to hold the first tool in an extended protruding position with its working end protruding farther from the housing than the working end of the second tool. The device further includes a relief valve that selectively and controllably permits liquid to be exhausted from the piston chamber when the liquid pressure exceeds a predetermined limiting value. Therefore, as the press ram is operated through a single stroke, the first tool first contacts the work piece to perform one function. When the press ram pressure and, hence the pressure applied to the work piece causes the pressure of the liquid to exceed the predetermined limiting value of the relief valve, the valve operates to permit liquid to be exhausted from the piston chamber. The first tool then may retract into the chamber. Thereafter, during further operation of the press ram through its stroke, the working end of the second tool is moved beyond the working end of the first tool to press the workpiece and perform a second function.

26 Claims, 8 Drawing Figures

46
138
142
32
88
26
140
137
134
136
44
100
42
104
94
43
90
98
106
94
92
137
130
36
108
102
42
112
118
114
116
122
120
34
132
128
48
26
32
102
112
120
110
122
140
134
130
132
118
128
114
116

DUAL FUNCTION, SINGLE STROKE PRESSING DEVICE

BACKGROUND OF THE INVENTION

1. Field of the Invention

The present invention relates to a device for performing at least two operations on one or more workpieces in a single stroke of a press ram. More particularly, the present invention relates to a pressing and staking device that first presses two workpieces together and thereafter stakes one of the workpieces to secure the two together. The present invention also relates to a method for applying, in a single stroke of a press ram, pressure to one workpiece to, for example, fit it to a second workpiece, and thereafter applying a different pressure to one of the workpieces to, for example, stake it and secure the two together.

2. Description of the Prior Art

Pressing and staking devices are known. For example, U.S. Pat. No. 3,111,867 (Riggio) discloses a double-acting staking apparatus that comprises a first piston for supporting an assembly of workpieces and for moving the workpieces upwardly toward a punch holder. A staking punch is slidable in the holder and operated by a second piston. In operation, the first piston moves the assembly of workpieces upwardly toward the punch holder to apply a predetermined pressure to the assembly. Then, the staking punch is moved downwardly in a direction opposite the direction of the first piston, to stake one of the workpieces to complete the assembly.

U.S. Pat. No. 4,035,901 (Lux et al) discloses an apparatus for joining two abutting metal members and has a single reciprocating head comprising a section that performs a lancing and forming operation on a first stroke of the head and a second section that performs a staking operation on a second stroke of the head.

A press for assembling a fastener to a workpiece is disclosed in U.S. Pat. No. 3,465,410 (Ernest et al.).

SUMMARY OF THE INVENTION

A device in accordance with the present invention performs at least two pressing operations on one or more workpieces in a single stroke of a press ram. The device comprises a housing carrying first and second tools each having a working end protruding from one end of the housing. The device may be in the form of a convenient press ram adaptor and therefore may be made to be removably attachable at an end of the housing opposite the one end, to the press ram to be reciprocated therewith.

The first tool has a shank portion mounted for reciprocal movement in the housing. The device further includes pressure applying apparatus operable on the shank portion to hold the first tool in an extended protruding position with its working end protruding farther from the housing than the working end of the second tool. Pressure relieving apparatus relieves fluid pressure on the shank portion when the press ram operates in its single stroke to apply a predetermined pressure through the working end of the first tool to the workpiece. Thereafter, the first tool is permitted to retract at least partially into the housing so that further movement of the press ram causes the working end of the second tool to protrude to an operative position beyond the working end of the first tool.

In the preferred embodiment of the present invention the shank portion of the first tool comprises a piston mounted for slidable, reciprocal movement in a piston chamber in the housing. Pressurized liquid fills the piston chamber to urge the first tool in its extended protruding position. A relief valve permits liquid to be exhausted from the piston chamber when the pressure of the piston on the liquid, developed in reaction to contact of the first tool with a workpiece by movement of the ram, exceeds a predetermined limiting value. Therefore, the first tool may retract at least partially into the housing, permitting the working end of the second tool to protrude beyond the first tool. The device further includes apparatus for resupplying pressurized liquid to the piston chamber and restoring the first tool to its extended position.

The device of the invention may be used for pressing and staking where a first workpiece is fitted to a second workpiece and then one or both is staked to secure the two workpieces together. These two functions are performed with a single stroke of the press ram. When so used, the first tool of the device of the invention may be the pressing tool that fits the workpieces together and the second tool may be a staking punch for staking one or both of the workpieces, deforming it and completing the interattachment.

The pressing device in accordance with the present invention is relatively simple and may be removably attached to the ram of a conventional press. The pressing device may also perform embossing, coining and drawing operations.

The foregoing advantages and other advantages of a pressing device in accordance with the present invention will be apparent from the following description of the preferred embodiments with reference to the drawings.

DESCRIPTION OF THE PREFERRED EMBODIMENTS

Figure 1:
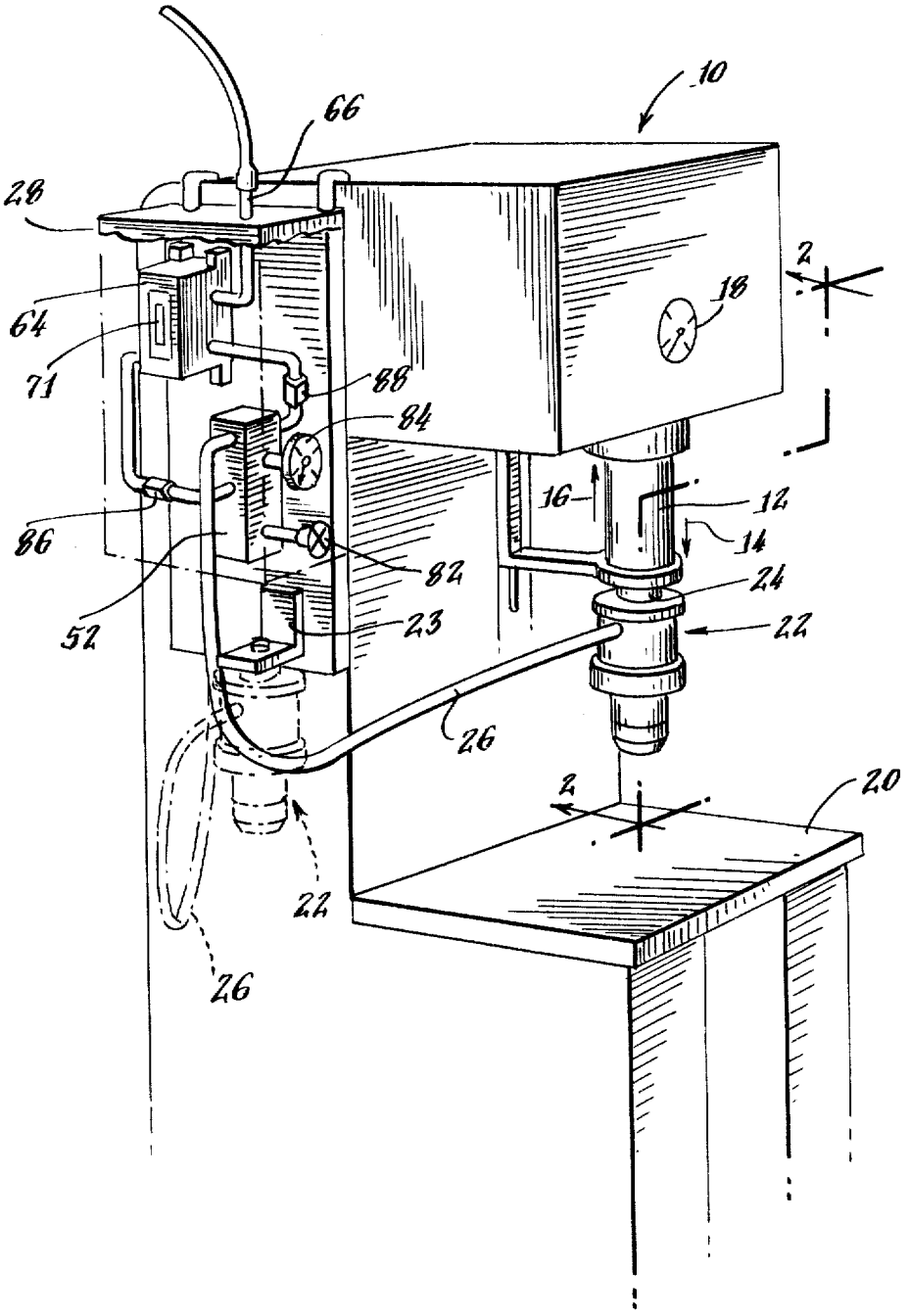
FIG. 1 is a perspective view of a conventional press having a ram. A pressing device in accordance with the present invention is attached to the ram. A hydraulic supply is shown with its cover in phantom lines to expose its internal components.

Referring first to FIG. 1, the device of the present invention is adapted for use with a conventional press 10 that includes a reciprocating press ram 12 moveable in a downward stroke as shown by arrow 14 and in an upward stroke as shown by arrow 16. The press ram 12 shown is driven by a conventional hydraulic piston and cylinder apparatus (not shown). However, it should be understood that the device of the present invention may be used with various types of presses having rams driven by other means.

Press 10 includes a pressure gauge 18 for indicating the pressure applied by the press ram 12. The press 10 further includes a platform 20 for supporting one or more workpieces on which operations are to be performed.

The device in accordance with the present invention includes an adaptor head generally indicated at 22 that may be removably attached to the end 24 of the ram 12. The operating components of the head are driven by pressurized fluid, the supply of which is controlled by a regulating apparatus 28, mounted on the side of the press. The cover of the apparatus 28 is shown by phantom lines to reveal its internal components, which will be described in greater detail below. A flexible hydraulic conduit 26 provides fluid communication between head 22 and the regulator apparatus 28.

As further shown by phantom lines in FIG. 1, the adaptor head 22 can be removed from the end 24 of the ram 12 and placed in a rack 23 mounted on the side of the press. Therefore, when the head 22 is not in use it may be placed out of the way of the ram so that the press 10 can be used for other purposes.

Figures 2, 3, 4:
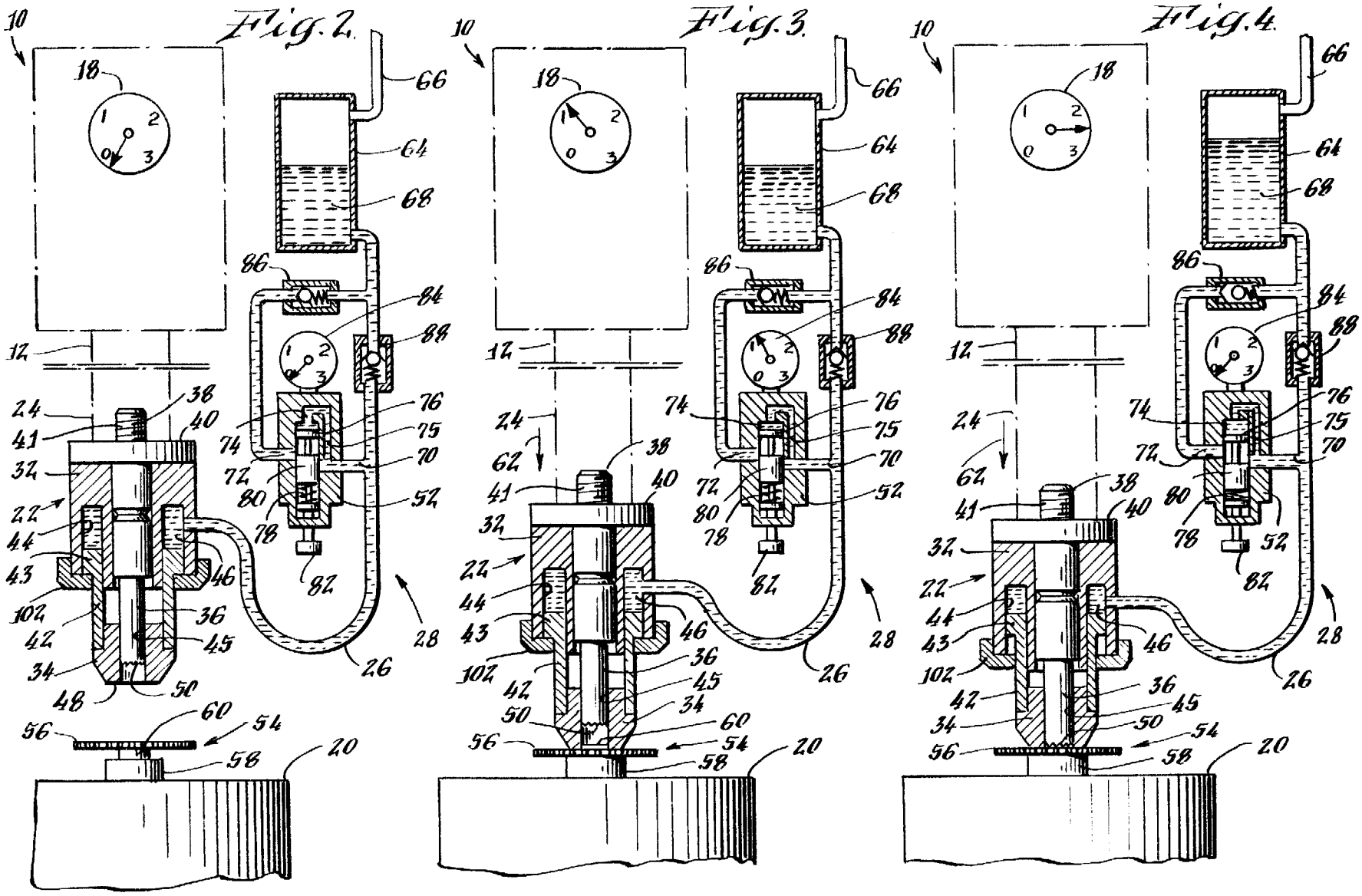
FIG. 2 is a schematic vertical cross-sectional view taken on plane 2—2 in FIG. 1 of the pressing device of the invention in a position prior to performing pressing operations on two workpieces.
FIG. 3 is a schematic vertical cross-sectional view of the device similar to that of FIG. 2 after the first tool has contacted a portion of one workpiece and prior to contact by the second tool with a second workpiece.
FIG. 4 is a schematic vertical cross-sectional view of the device also similar to FIG. 2 with the second tool in contact with the second workpiece.

FIGS. 2, 3 and 4 illustrate the pressing device of the invention in greater detail. As shown there, the adaptor head 22 includes a housing 32, that carries a first tool 34 and a second tool 36. The housing 32 is removably attached to the end 24 of press ram 12 by a threaded bolt 38 that extends axially from one end 40 of housing 32 and is received in a threaded bore 41 in the end 24 of the ram. Of course, other means for attaching the head 22 to the ram may be used.

The first tool 34 of the adaptor head has a shank portion 42 terminating in a piston 43 received for sliding reciprocal movement in a piston chamber 44 formed in the housing 32. The first tool has an axial bore 45 and the second tool is mounted, in fixed relation to the housing and ram, within this bore. Pressurized fluid, preferably a hydraulic fluid 46 is supplied to the piston chamber 44 by the regulator apparatus, in a manner described below, to hold the first tool in an extended protruding position. In this position, the working end 48 of the first tool, that is the end designed to contact a workpiece, protrudes farther from the housing than the working end 50 of the second tool 36. Indeed, the working end of the second tool is recessed within the bore of the first tool and is shielded by its working end 48. Accordingly, a downward stroke of the ram will simultaneously move the head downwardly so that the working end 48 of the first tool will first contact a workpiece. However, if the first tool 34 is permitted to retract into the housing 32 eventually further downward stroke of the ram will cause the second tool to contact the workpiece. The regulator apparatus determines at what pressure of the ram on the first tool, that is at what limiting pressure, the first tool is permitted to so retract. Only thereafter does the second tool become operative to perform its operation on the workpiece.

The regulator apparatus 28 includes a relief valve 52 that allows liquid to be exhausted from the piston chamber 44 when the pressure of piston 43 on hydraulic fluid 46 developed in reaction to the pressure applied by the ram when the first tool contacts the workpiece, reaches a predetermined value.

The components of the regulator apparatus 28, also shown in FIGS. 1 through 4, include an air and hydraulic fluid tank 64 having a tube 66 extending therefrom to a source of compressed gas such as air. The tank 64 is partially filled with hydraulic fluid 68 and includes a liquid level sight gauge 71 for checking the level of hydraulic fluid in the tank.

The relief valve 52 is connected across the conduit 26, which communicates between the tank 64 and the head 22. It includes an inlet 70, an outlet 72 and a cylinder 74 in which a spool-shaped piston 76 is slidably reciprocally received. Piston 76 is urged upwardly in the cylinder by a spring 78 compressed against the lower portion of the piston. The force exerted by the spring 78 is adjustable by means of an adjustment knob 82. Fluid pressure is communicated to the opposite end of the piston 76 by an internal passageway 75 communicating from the inlet 70. This pressure acts to urge the piston in a direction opposite that urged by the spring. Relief valve 52 also includes a pressure gauge 84 for reading the pressure of the liquid in cylinder 74.

Referring now to FIG. 2, the pressure of the fluid 46 in the chamber 44 is applied to the piston 76 of the relief valve 52 to urge the piston 76 downwardly against the force of the spring 78. When the pressure of the liquid reaches a value, the limiting value, sufficient to move piston 76 downwardly enough to allow passage of fluid through relief valve 52 from the inlet to the outlet 72 past a reduced diameter portion of the piston, fluid may be exhausted from the chamber 44 of the head 22. A one-way check valve 86 allows fluid to flow from head 22 to tank 64 through relief valve. A similar check valve 88 allows fluid to flow from the tank to the head, bypassing the check valve 86. When pressure is removed from the first tool to thereby relieve pressure on the hydraulic fluid 46 in the chamber 44, relief valve 52 closes. That is, the spring 78 urges piston 76 upwardly so that its lower portion 80 closes the passage between the inlet 70 and outlet 72 and prevents further passage of liquid therethrough. One-way check valve 88 allows flow of fluid from tank 64 through conduit 26 to restore the first tool to the extended position.

The operation of the pressing device will be described with reference to FIGS. 2, 3 and 4. FIG. 2 is a cross-sectional view of the pressing device prior to contact by the first tool with the workpiece 54. The workpiece shown in FIGS. 2, 3 and 4, by way of example, may be a gear 56 which is to be mounted on a shaft 58 having a cylindrical plug 60 which is to be press fitted into a central hole in gear 56. The pressing device may, however, be used to perform different functions on various other workpieces.

Press 10 is actuated to move press ram 12 downwardly with respect to platform 20 to move the tools 34 and 36 toward workpiece 54. The working end 48 of the first tool 34 first contacts the upper surface of the gear 56 and drives the gear downwardly onto the cylindrical plug 60 on shaft 58 to the position shown in FIG. 3. As ram 12 continues to move downwardly, the pressure of the hydraulic fluid 46 in the chamber 44 increases to the limiting value at which the relief valve 52 trips. The fluid is then permitted to exhaust from piston chamber 44 through the valve. Therefore, when this limiting pressure value is reached, the first tool 34 may retract into the chamber 44 relative to the housing 32. FIG. 3 shows the pressing device just prior to release of hydraulic fluid from piston chamber 44.

As shown in FIG. 4, continued downward movement of the ram continues downward movement of the second tool 36 after the first tool has begun to retract into the chamber 44. When sufficient quantity of hydraulic fluid has been released from piston chamber 44 the second tool 36 can contact the workpiece to perform its operation. In the case of the device shown in FIG. 4, the second tool 36 is a staking punch that plastically deforms the cylindrical plug 60 of the shaft to thereby spread it into tight engagement with the gear, connecting the two together. After the staking punch 36 has applied the desired pressure on the workpiece 54 transmitted directly through the punch from the ram, press 10 is operated to withdraw the ram to the position shown in FIG. 2. The pressure is therefore removed from the first tool and the relief valve is permitted to close. During withdrawal of piston ram 12, pressurized fluid is then again supplied to piston chamber 44 via the conduit 26 and the first tool is restored to its extended protruding position as shown in FIG. 2. The pressing device is then ready to press another workpiece.

Figures 5, 6:
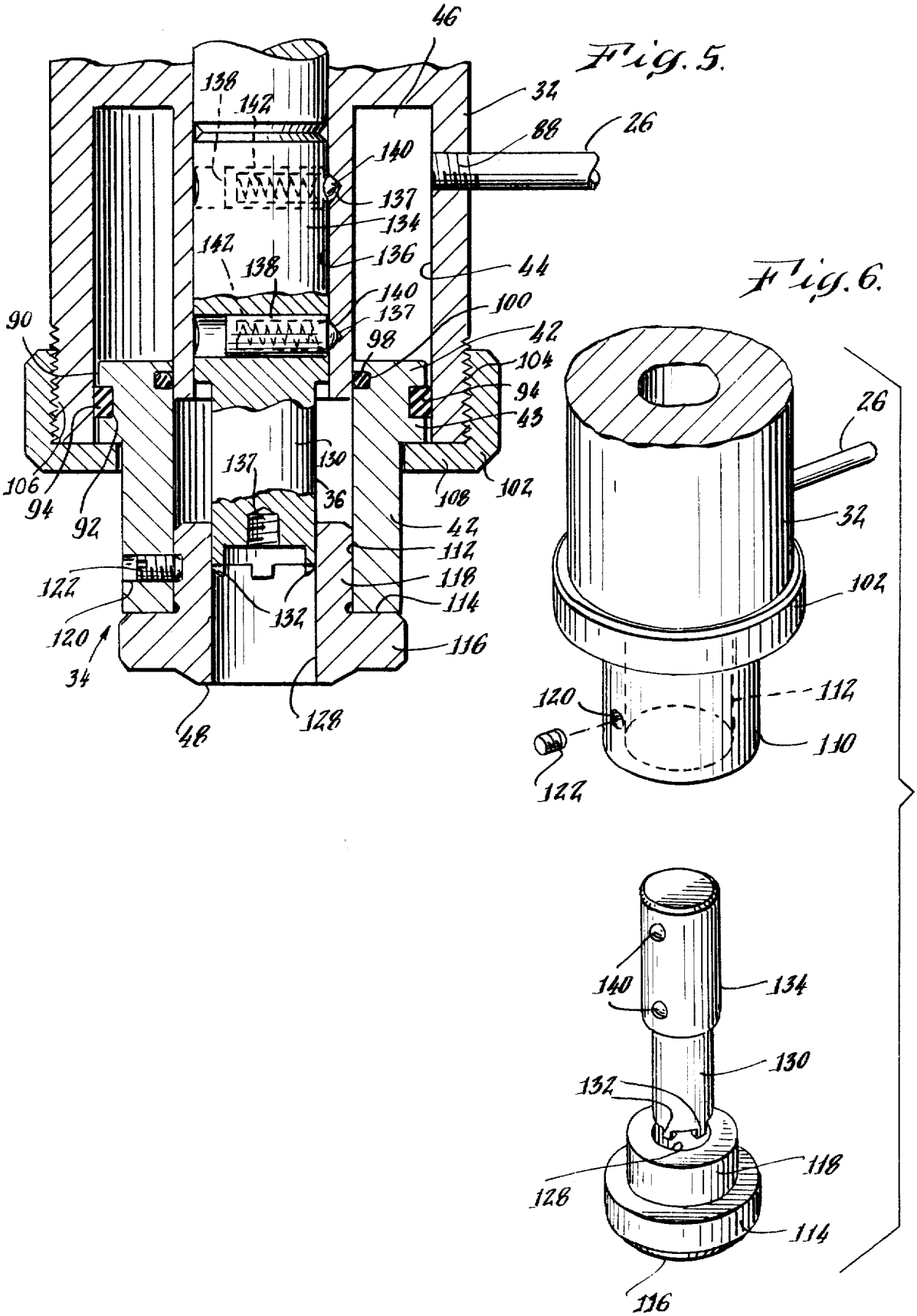
FIG. 5 is an enlarged vertical cross-sectional view of the lower portion of the head of the pressing device.
FIG. 6 is an exploded perspective view of the head of the device shown in FIG. 5.

A preferred construction of the head 22 is shown in FIGS. 5 and 6. There, the housing 32 includes an annular piston chamber 44 for receiving the annular piston 43, which has a larger diameter then the shank portion 42 of the first tool 34. A liquid inlet and outlet 88 connects the conduit 26 to the chamber 44. Piston 43 is slidable within annular chamber 44 in response to pressurized fluid from the supply.

The outer surface 90 of piston 43 includes a groove 92 that receives an annular sealing ring 94 and similarly, the inner surface 96 includes a groove 98 that receives sealing ring 100. The piston 43 is held within piston chamber 44 by a retaining ring 102 that includes a threaded portion 104 which engages a mating thread 106 on the exterior of housing 32. Ring 102 includes an annular flange 108 which abuts piston 43 when the piston is in the extended position as shown in FIG. 5 yet permits the shank portion 42 to project therethrough.

The shank portion 42 of the first tool 34 is tubular as noted above, extends from piston 43, is preferably integral therewith, and has an inner surface 112 and a bottom surface 114. A bushing 116 is mounted in the shank portion 42 and includes an annular wall 118 having an outer diameter sized to be received within the inner surface 112. A set screw 122 is tapped into the shank portion 42 in a threaded bore. The screw may be tightened to engage the wall 118 of the bushing 116 and secure it in the shank portion. Bushing 116 includes the working end 48 of the first tool for pressing a portion of the workpiece.

Bushing 116 includes an axial bore 128 for receiving the second tool 36, which, in the case of the tool shown in FIG. 5, is a staking punch 130. Staking punch 130 is slidable relative to bushing 116 in bore 128 and includes several punching points 132 on the working end thereof. The stem 134 of punch 130 is sized to be received by a punch retaining cavity 136 in housing 32. The stem 134 includes at least one and preferably two cavities 138 that extend transversely to the axis of the punch and that receive spring loaded ball retainers 140. The retainers are urged against the wall of cavity 136 into shallow sockets 137 formed therein by springs 142 to retain punch 130 in cavity 136. The punch 130 may also have an axial threaded socket 139 that receives a threaded handle (not shown) to assist removal of the punch from the housing.

It should be understood that both the bushing 116 and the punch 130 are removably secured to the head 22 of the pressing device for replacement by tools having different sizes or different shapes. To remove the punch 130 and the bushing 116, set screw 122 is loosened to disengage annular wall 118. Then the bushing can be withdrawn from the shank portion 42. After bushing 116 is removed, the punch 130 may be grasped and pulled downwardly, with the assistance of a handle if needed, out of cavity 136. Thereafter, a bushing and a punch having a different size may be installed. For example, the pressing device is adaptable to be used on a larger workpiece wherein the outer diameter of the end portion of punch 130 would be larger and the diameter of aperture 128 of bushing 116 would be larger. Moreover, it may be desirable to provide a substitute punch or bushing having different end configurations.

Figure 7:
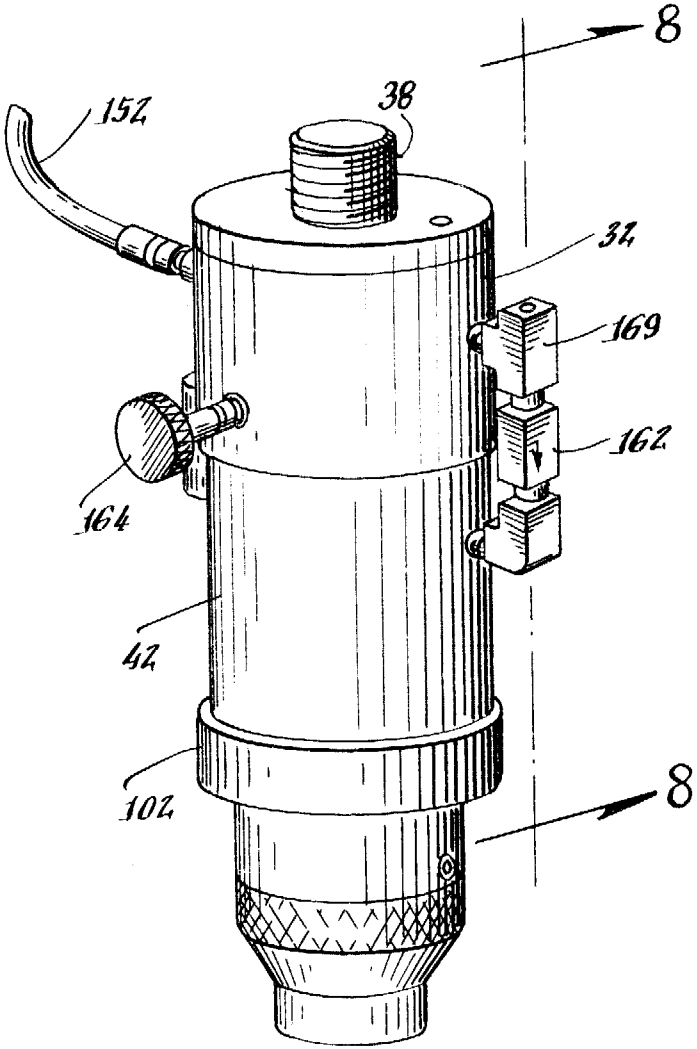
FIG. 7 is a perspective view of an alternate embodiment of the device of the present invention.
Figure 8:
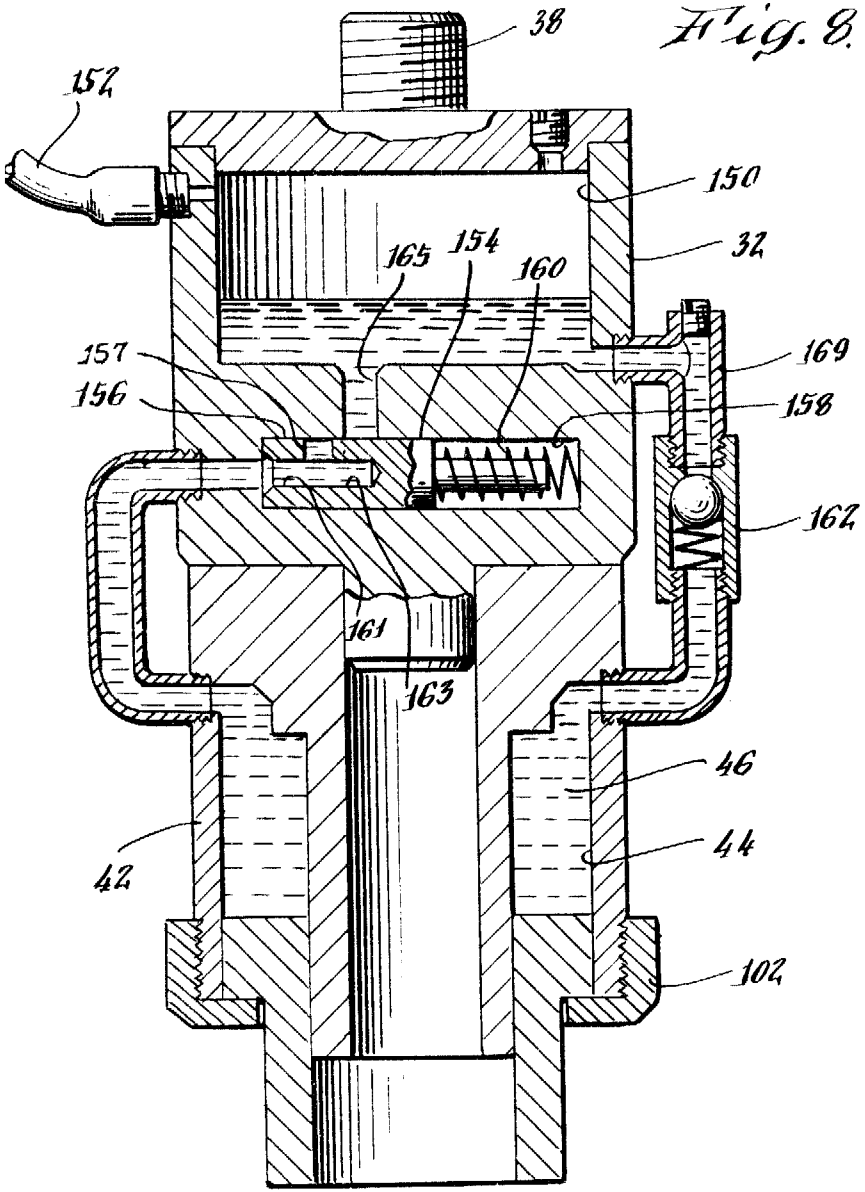
FIG. 8 is a vertical cross-sectional view of the alternative embodiment taken on plane 8—8 in FIG. 7.

Referring to FIGS. 7 and 8, an alternative embodiment of the pressing device is shown. The pressing device is quite similar in operation to that device described above with the exception that the regulator apparatus is integrated within the head of the device. For simplicity, the pressing punch and the bushing are not shown in FIG. 8. It should be understood, however, that the lower part of the head of the pressing device is the same as that shown in FIGS. 5 and 6 and the same reference characters will be applied thereto.

The upper part of housing 32 includes an air and hydraulic fluid tank 150 capable of being connected via conduit 152 to a supply of pressurized gas. The tank 150 is connected to piston chamber 44 through a pressure relief valve 154 that allows fluid to be exhausted from piston chamber 44 when the fluid pressure reaches the limiting value. This relief valve 154 includes a cylindrical piston 156 having an internal T-shaped passageway 157 the leg and one arm 161 of which are opened but the other arm 163 of which is closed. This piston is slidable in piston cylinder 158. Piston 156 is urged by a spring 160 to a position wherein the leg 159 is displaced from the valve outlet 165 to prevent flow of liquid through the valve. As the hydraulic fluid pressure increases in the chamber 44 due to compression of the first tool against the workpiece, piston 156 is urged rightwardly by fluid pressure against the wall of closed arm 163 against spring 160 until the limiting pressure is reached. Then the fluid is allowed to pass out of piston chamber 44 into the tank 150. Release of liquid from piston chamber provides for withdrawal of the first tool into housing 32. When pressure on the first tool is released, relief valve 154 closes under influence of the spring and liquid from tank 150 is again supplied to piston chamber 44 through a conduit 164 via a one-way check valve 162.

The compression of spring 160 may be adjusted by adjustment knob 164 shown in FIG. 7 to provide for actuation of valve 154 at different predetermined pressures. It should be understood that the pressing device shown in FIGS. 7 and 8 may be readily attached to the ram of a press, such as the ram shown in FIG. 1.

Accordingly, although specific embodiments of the present invention have been described above in detail, it is to be understood that this is for purposes of illustration. Modifications may be made by those skilled in the art for purposes of adapting the invention to particular applications.

What is claimed is:

1. In an apparatus including one press ram and means for reciprocally moving said ram through sequential pressing and retracting strokes, a pressing device for performing at least two pressing operations on at least one workpiece in a single pressing stroke of said ram, said device comprising:

a housing mountable for reciprocal movement with said press ram;

first and second tools mounted at one end of said housing and each having a working end protruding in the general direction of said pressing stroke from said one end, said housing defining a piston chamber and said first tool being formed with a piston slidable in said piston chamber in the general direction of said pressing and retracting strokes to mount said first tool for reciprocal movement between an extended position with its working end protruding farther from said housing than said second tool working end, and a retracted position with its working end protruding less far from said housing than said second tool working end;

means for storing fluid;

means for pressurizing fluid in said storing means and being operable independently of said ram moving means;

means for supplying the pressurized fluid along one path from said storing means to said piston chamber to normally hold said first tool in said extended position; and means for relieving the pressure of fluid in said piston chamber and thereafter returning fluid along a second path to said storing means when the pressure applied by said first tool working end to said workpiece, in response to movement thereof with said ram and said housing by said ram moving means, reaches a predetermined pressure during an initial portion of a pressing stroke, thereby permitting said first tool to move to said retracted position and permitting said second tool working end to thereafter press said workpiece, in response to further movement thereof with said ram and said housing by said ram moving means, during the remaining portion of the pressing stroke.

2. A device according to claim 1, wherein said relieving means comprises a relief valve permitting said pressurized fluid to flow out of said piston chamber along said second path to said storing means when the pressure of said piston on said fluid caused by reaction of said first tool with said workpiece reaches a predetermined value.

3. A device according to claim 1, wherein pressurized fluid may be returned to said piston chamber along said one path by said supplying means.

4. A device according to claim 2, wherein said fluid is a liquid, wherein said storing means is a tank for holding said liquid, and wherein said supplying means comprises an outlet passage including said relief valve communicating between said piston chamber and said tank, a return passage, means for supplying pressurized gas to said tank, and a check valve in said return passage.

5. A device according to claim 4, wherein said tank, said relief valve, and said check valve are mounted at a location remote from said press ram, wherein said device further comprises a flexible conduit for connecting said relief valve and check valve to said piston chamber.

6. A device according to claim 4, wherein said tank, said relief valve and said check valve are assembled as an integrated unit mountable on said press ram.

7. A device according to claim 1, wherein the working end of the first tool comprises a bushing for pressing a portion of said workpiece; wherein said second tool comprises a punch for deforming a different portion of said workpiece.

8. A device according to claim 7, wherein said bushing slidably receives and supports an end portion of said punch.

9. A device according to claim 7, wherein said housing is formed with an axial cavity and wherein said punch is formed with a stem removably received in said cavity.

10. A device according to claim 7 wherein said bushing is detachably mounted with said first tool for removal and replacement.

11. A device according to claim 9 wherein said stem of said punch comprises means for retaining said stem in said axial cavity.

12. A device according to claim 11 wherein said retaining means comprises at least one spring loaded element mounted transversely in said punch stem for maintaining frictional engagement with a wall of said cavity.

13. A device according to claim 7 wherein said first tool comprises a tubular piston rod, wherein said bushing comprises an annular wall received by said tubular piston rod, and wherein said device further comprises means for removably securing said annular wall to said tubular piston rod.

14. A device according to claim 1 wherein said housing is removable from said press ram and is storable at a location remote from the press ram.

15. A device according to claim 1 further including means for varying said predetermined pressure at which said relieving means operates to relieve the pressure of fluid in said piston chamber.

16. A device according to claim 1 wherein said device is adapted to press a first workpiece to a second workpiece and stake the two together, wherein said first tool is a pressing tool, said working end of which is formed to press said workpieces together and wherein said second tool is a staking punch, said working end of which is formed to plastically deform at least one of said workpieces to stake it to the other of said workpieces.

17. In an apparatus including one press ram and means for moving said ram through sequential pressing and retracting strokes, a head for performing at least two pressing operations on at least one workpiece in a single pressing stroke of said ram and being provided with motive power by means for supplying pressurized fluid thereto but, when the pressure of said fluid exceeds a limiting value, interrupting supply of said fluid and relieving the pressure thereon, said head comprising:

a housing mountable at one end with said ram for movement therewith and being formed with a piston chamber;

first and second tools mounted at an end of said housing opposite said one end, each having a working end protruding in the general direction of said pressing stroke from said opposite end, said first tool having a piston received for reciprocal sliding movement in the general direction of said pressing and retracting strokes in said piston chamber between an extended position with its working end protruding farther from said housing than said second tool working end and a retracted position with its working end protruding less far from said housing than said second tool working end;

means for storing fluid;

means, operable independently of said press ram moving means, for pressurizing fluid in said storing means;

means for supplying the pressurized fluid from said storing means to said piston chamber to normally hold said first tool in said extended position; and means for interrupting supply of liquid to and for relieving the pressure of liquid in said piston chamber and for returning fluid to said storing means when the pressure of liquid in said piston chamber exceeds the limiting value, whereby:

in a single stroke of said press ram said first working end presses said workpiece until said limiting value is exceeded and thereafter said supply of fluid to said piston chamber is interrupted and the pressure on said fluid is relieved in said piston chamber, thereby permitting said first tool to move to said retracted position and expose said second tool working end to press said workpiece.

18. A device according to claim 17, wherein the working end of the first tool comprises a bushing for pressing a portion of said workpiece; wherein said second tool comprises a punch for deforming a different portion of said workpiece.

19. A device according to claim 18, wherein said bushing slidably receives and supports an end portion of said punch.

20. A device according to claim 18, wherein said housing is formed with an axial cavity and wherein said punch is formed with a stem removably received in said cavity.

21. A device according to claim 18, wherein said bushing is detachably mounted with said first tool for removal and replacement.

22. A device according to claim 20, wherein said stem of said punch comprises means for retaining said stem in said axial cavity.

23. A device according to claim 22, wherein said retaining means comprises at least one spring loaded element mounted transversely in said punch stem for maintaining frictional engagement with a wall of said cavity.

24. A device according to claim 18, wherein said first tool comprises a tubular piston rod, wherein said bushing comprises an annular wall received by said tubular piston rod, and wherein said device further comprises means for removably securing said annular wall to said tubular piston rod.

25. A device according to claim 17, wherein said housing is removable from said press ram and is storable at a location remote from the press ram.

26. A method for applying a first pressure to at least one workpiece and a second different pressure to said workpiece in a single pressing stroke of a press ram mounted for reciprocal movement through sequential pressing and retracting strokes, the method comprising:

providing a housing mounted for reciprocal movement with said press ram and that defines a piston chamber;

providing first and second tools, each having a working end and both being mounted for simultaneous movement with said press ram toward said workpiece in a pressing stroke thereof, said first tool including a piston mounted for reciprocal sliding movement in said chamber, in the direction of said pressing and retracting strokes;

urging said first tool working end to project from said press ram in the direction of the pressing stroke to an extended position closer to its operative position relative to said workpiece than is said second tool working end to its operative position relative to said workpiece by supplying fluid to said piston chamber from a supply under pressure developed independently of movement of said press ram;

moving said first and second tools toward said workpiece in a first portion of a single pressing stroke of said press ram;

pressing said workpiece with said first tool working end at increasing pressure in response to said moving;

when the pressure of said first tool working end on said workpiece exceeds said first pressure, relieving the pressure of fluid urging said first tool working end to said extended position, permitting fluid to return from said piston chamber to said supply, and thereby permitting said first tool to retract away from its operative position in a remaining portion of said single pressing stroke of said press ram until said second tool working end moves to its operative position and contacts said workpiece;

pressing said workpiece with said second tool working end at said second pressure in final portion of said single pressing stroke of said press ram.

* * * * *